US006369778B1

(12) United States Patent
Dockery

(10) Patent No.: US 6,369,778 B1
(45) Date of Patent: Apr. 9, 2002

(54) ANTENNA HAVING MULTI-DIRECTIONAL SPIRAL ELEMENT

(76) Inventor: Gregory A. Dockery, 3701 Plains Blvd. No. 83A, Amarillo, TX (US) 79102

( * ) Notice: Subject to any disclaimer, the term of this patent is extended or adjusted under 35 U.S.C. 154(b) by 0 days.

(21) Appl. No.: 09/902,716

(22) Filed: Jul. 12, 2001

Related U.S. Application Data

(63) Continuation-in-part of application No. 09/591,312, filed on Jun. 9, 2000, now Pat. No. 6,317,101.
(60) Provisional application No. 60/138,977, filed on Jun. 14, 1999.

(51) Int. Cl.[7] ..... H01Q 1/36
(52) U.S. Cl. ..... 343/895
(58) Field of Search ..... 343/700 MS, 741, 343/742, 866, 867, 895; H01D 1/36

(56) References Cited

U.S. PATENT DOCUMENTS 3,656,168 A 4/1972 Stropki
3,956,751 A * 5/1976 Herman ..... 343/744
4,087,821 A * 5/1978 Phelan ..... 343/754
4,583,099 A 4/1986 Reilly et al.
4,658,264 A * 4/1987 Baker ..... 343/895
5,640,170 A 6/1997 Anderson
5,646,633 A 7/1997 Dahlberg
5,781,110 A 7/1998 Habeger, Jr. et al.
5,808,587 A * 9/1998 Shima ..... 343/895
5,812,331 A 9/1998 Lopez et al.
5,990,849 A 11/1999 Salvail et al.
6,160,526 A * 12/2000 Hirai et al. ..... 343/895

* cited by examiner

*Primary Examiner*—T. Phan
(74) *Attorney, Agent, or Firm*—Locke Liddell & Sapp LLP

(57) ABSTRACT

An antenna having multi-directional elements includes a conductive trace in the form of a spiral pattern having linear segments extending across multiple planes angularly disposed with respect to each other.

12 Claims, 9 Drawing Sheets

ANTENNA HAVING MULTI-DIRECTIONAL SPIRAL ELEMENT

RELATED APPLICATIONS

This application claims priority to U.S. Provisional Patent Application Serial No. 60/138,977 filed Jun. 14, 1999, and entitled "Spiral-Lateral Antenna" and is a continuation-in-part of U.S. patent application, Ser. No. 09/591,312 filed Jun. 9, 2000, and entitled "Antenna Having Multi-Directional Spiral Elements" and now U.S. Pat. No. 6,317,101.

TECHNICAL FIELD OF THE INVENTION

The present invention relates to antennas, and more particularly to antennas having multi-directional spiral elements.

BACKGROUND OF THE INVENTION

Antennas are used in connection with transmitters and receivers for radiating electromagnetic waves into or receiving electromagnetic waves from space. Antennas are typically directional which requires specific mounting criteria in order to receive maximum energy from a signal. For example television antennas are usually unable to receive maximum high-energy reception for all channel broadcast station signals, and such antennas must be rotated and specifically tuned for each broadcast station. Broadcast station signals may include, for example, UHF and VHF channels and FM signals.

A need has thus arisen for an antenna having a low profile, low-noise and which provides reception for multiple broadcast signals at maximum energy levels without the need for specific tuning.

SUMMARY OF THE INVENTION

In accordance with the present invention, an antenna is provided having multi-directional elements. Each element includes a conductive trace in the form of a spiral pattern extending across multiple planes angularly disposed with respect to each other.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
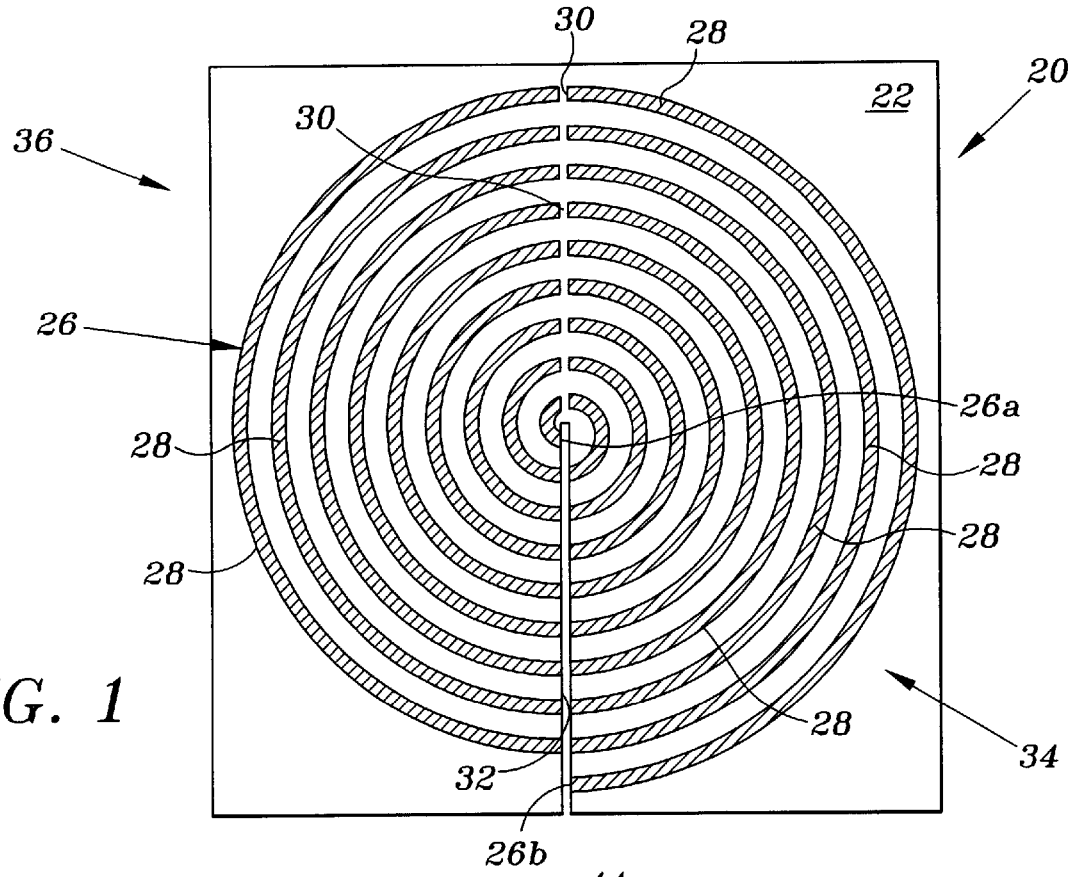
FIG. 1 is a top plan view of a substrate of one of the elements of the present antenna.
Figure 2:
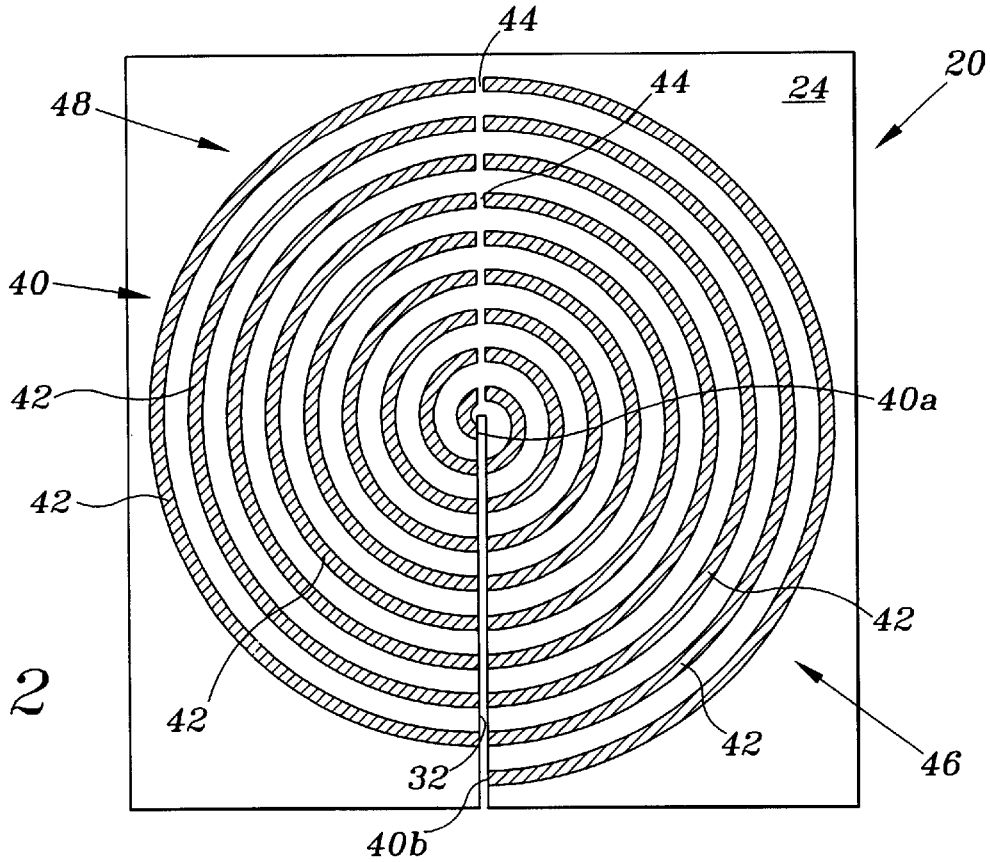
FIG. 2 is a bottom plan view of the substrate shown in FIG. 1.

Referring simultaneously to FIGS. 1 and 2, a first substrate, generally identified by the numeral 20 is illustrated. Substrate 20 comprises one element of the present antenna, and may be fabricated, for example, from printed circuit board material. FIG. 1 illustrates top surface 22 of substrate 20. FIG. 2 illustrates bottom surface 24 of substrate 20. Disposed on top surface 22 of substrate 20 is a spiral pattern formed of a conductive material such as, for example, copper, and is generally identified by the numeral 26. Spiral pattern 26 includes end 26*a* centrally disposed on top surface 22 of substrate 20 and end 26*b* disposed along the peripheral edge of substrate 20. Spiral pattern 26 includes a plurality of spaced apart arcuate segments 28 which extend between ends 26*a* and 26*b*. Disposed within arcuate segments 28 is a gap 30. Centrally disposed within substrate 20 is a slot 32. Slot 32 is aligned with gaps 30. Slot 32 and gaps 30 form half spiral patterns generally identified by the numerals 34 and 36.

FIG. 2 illustrates bottom surface 24 of substrate 20 and includes a spiral pattern, generally identified by the numeral 40 which is similarly configured to spiral pattern 26. Pattern 40 includes ends 40*a* and 40*b* and arcuate segments 42. Arcuate segments 42 include gaps 44. Gaps 44 together with slot 32 define half spiral patterns 46 and 48. Spiral patterns 26 and 40 may be fabricated using standard printed circuit board technology.

Figure 3:
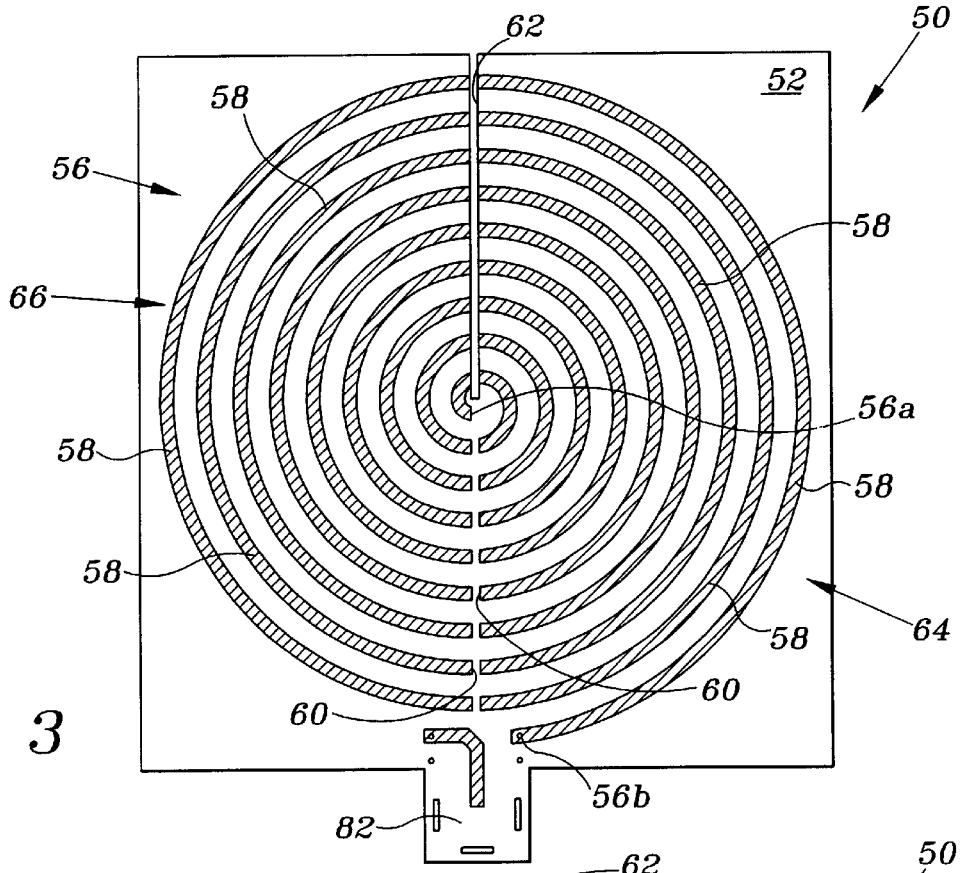
FIG. 3 is a top plan view of an additional substrate of an additional element of the present antenna.
Figure 4:
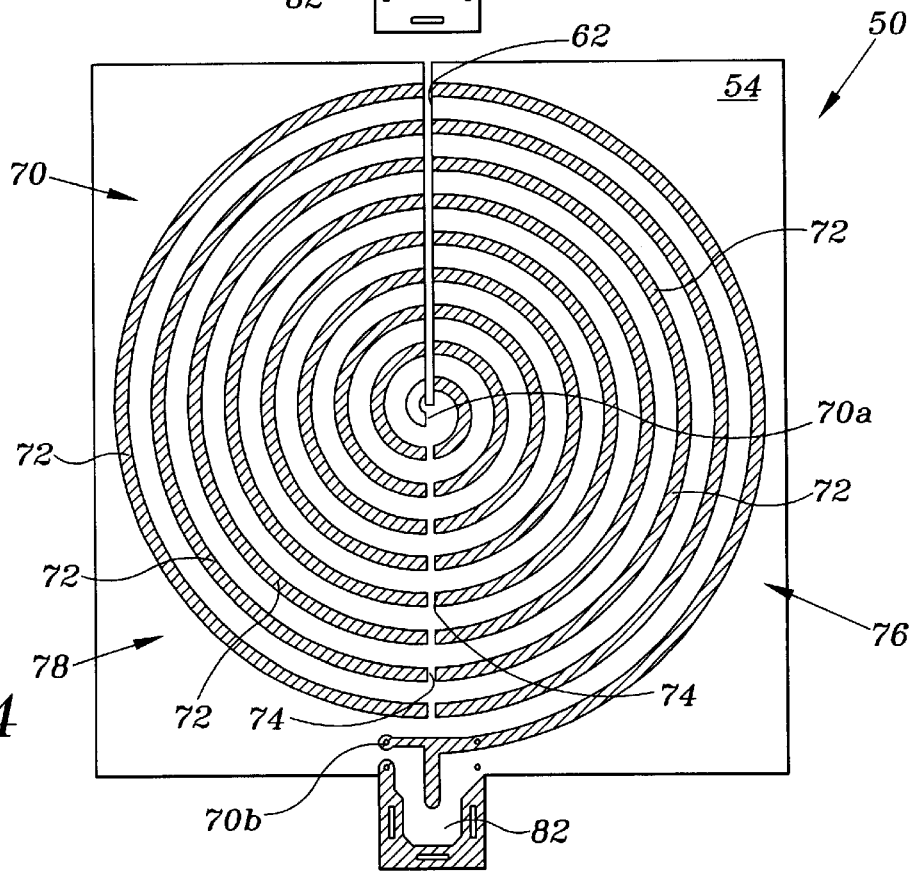
FIG. 4 is a bottom plan view of the substrate shown in FIG. 3.

Referring now to FIGS. 3 and 4, a second substrate, generally identified by the numeral 50 is illustrated. Substrate 50 comprises one element of the present antenna, and may be fabricated, for example, from printed circuit board material. FIG. 3 illustrates top surface 52 of substrate 50. FIG. 4 illustrates bottom surface 54 of substrate 50. Disposed on top surface 52 of substrate 50 is a spiral pattern formed of conductive material such as, for example, copper, and is generally identified by the numeral 56. Spiral pattern 56 includes end 56*a* centrally disposed on top surface 52 of substrate 50 and end 56*b* disposed along the peripheral edge of substrate 50. Spiral pattern 56 includes a plurality of spaced apart arcuate segments 58 which extend between ends 56*a* and 56*b*. Disposed within arcuate segments 58 is a gap 60. Centrally disposed within substrate 50 is a slot 62. Slot 62 is aligned with gaps 60. Slot 62 and gaps 60 form half spiral patterns generally identified by the numerals 64 and 66.

FIG. 4 illustrates bottom surface 54 of substrate 50 and includes a spiral pattern, generally identified by the numeral 70 which is similarly configured to spiral pattern 56. Pattern 70 includes ends 70*a* and 70*b* and arcuate segments 72. Arcuate segments 72 include gaps 74. Gaps 74 together with slot 62 define half spiral patterns 76 and 78. Spiral patterns 56 and 70 may be fabricated using standard printed circuit board technology.

Figure 5:
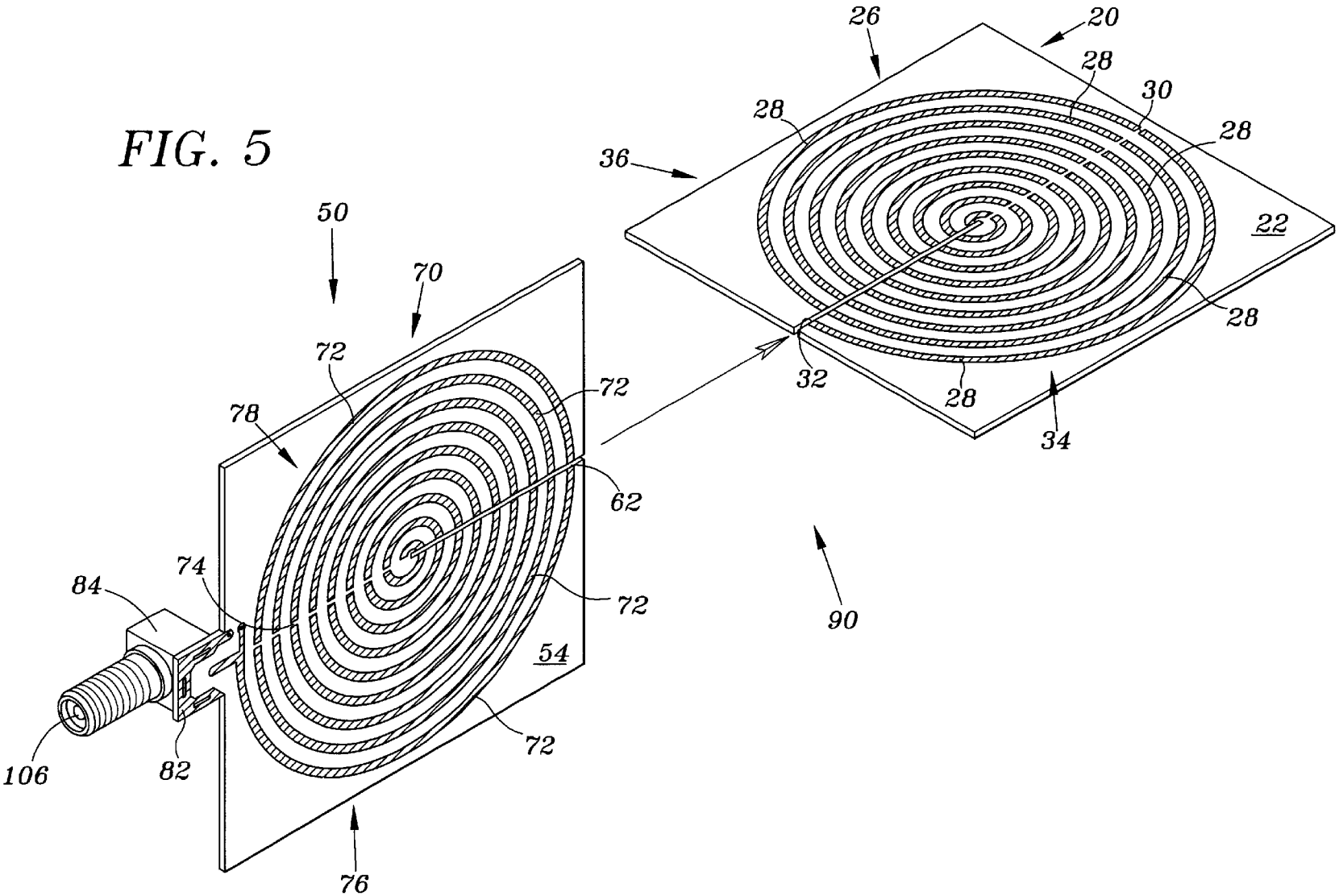
FIG. 5 is a perspective view illustrating assembly of the elements shown in FIGS. 1–4.

Substrate 50 includes an extension 82 for mounting an antenna connector 84 (FIG. 5).

Referring now to FIG. 5, substrate 20 and substrate 50 are aligned such that slot 62 of substrate 50 is inserted in slot 32 of substrate 20. Slot 62 thereby aligns with gaps 30 of substrate 20 and slot 32 aligns with gaps 74 of substrate 50. Substrates 20 and 50 are generally perpendicularly aligned to form the structure illustrated in FIG. 6 representing a first embodiment of the present antenna, generally identified by the numeral 90.

Figure 6:
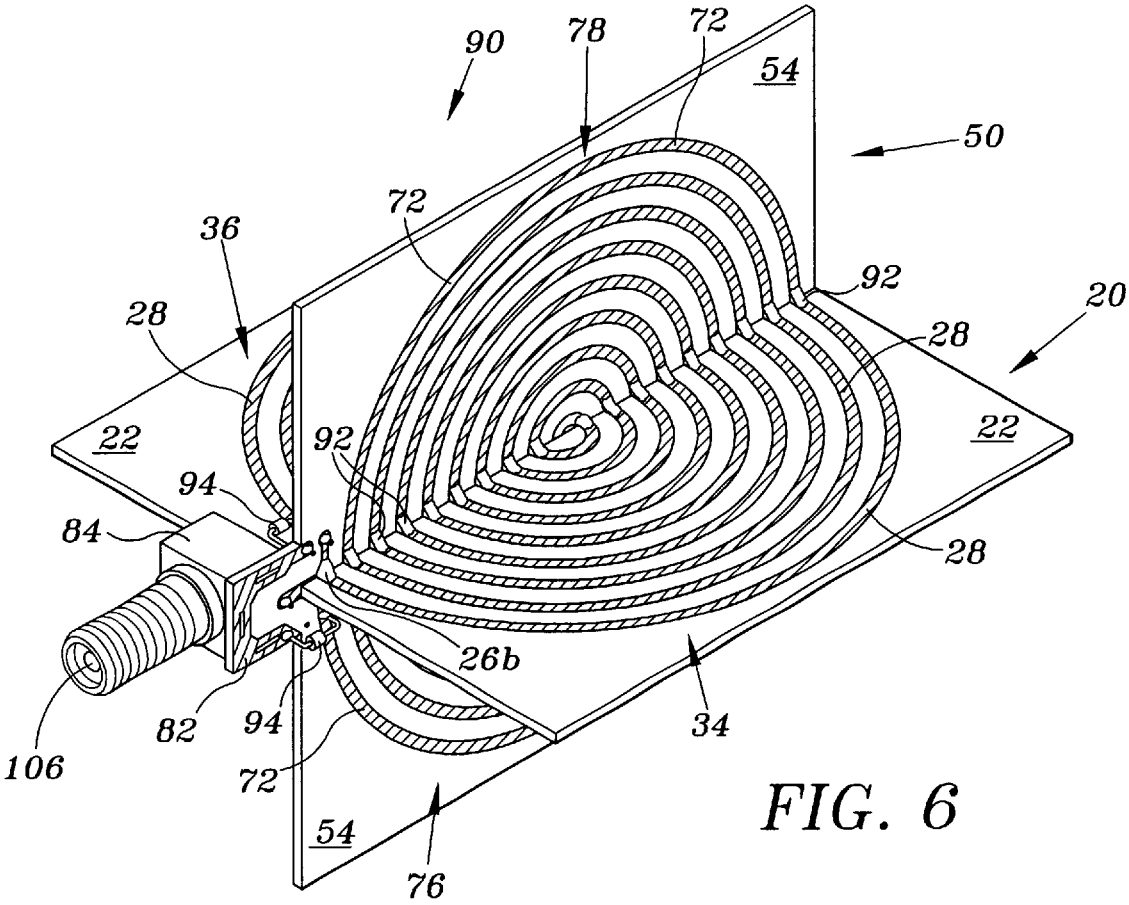
FIG. 6 is a perspective view of one embodiment of the present antenna.

Referring simultaneously to FIGS. 5 and 6, antenna 90 is formed by interconnecting adjacent half spiral patterns of spiral patterns 26, 40, 56, and 70 of each surface of substrates 20 and 50. As illustrated in FIG. 6, arcuate segments 28 of half spiral pattern 34 on top surface 22 of substrate 20 align with arcuate segments 72 of half spiral pattern 78 on bottom surface 54 of substrate 50. In this manner a completed spiral pattern is formed across substrates 20 and 50 and extends in multiple planes defined by substrates 20 and 50. Half spiral patterns 34 and 78 are interconnected by solder bridges 92 which form a continuous spiral, bridging gaps 30 and 74. In a similar manner, each adjacent half spiral pattern of each top and bottom surface of substrates 20 and 50 are interconnected using solder bridges 92. Adjacent half spiral patterns 64 and 36, 48 and 66, 76 and 46, are each connected by solder bridges 92, thereby forming four complete spiral patterns, each complete spiral pattern extending in two generally perpendicular planes defined by substrates 20 and 50. As a result, antenna 90 includes four spiral patterns disposed at approximately 90° of each other creating a bidirectional antenna having laterally spaced apart spirals at each antenna element. Received energy from broadcast station signals can therefore be received at multiple angles by antenna 90, and antenna 90 need not be turned for a single direction.

Figure 7:
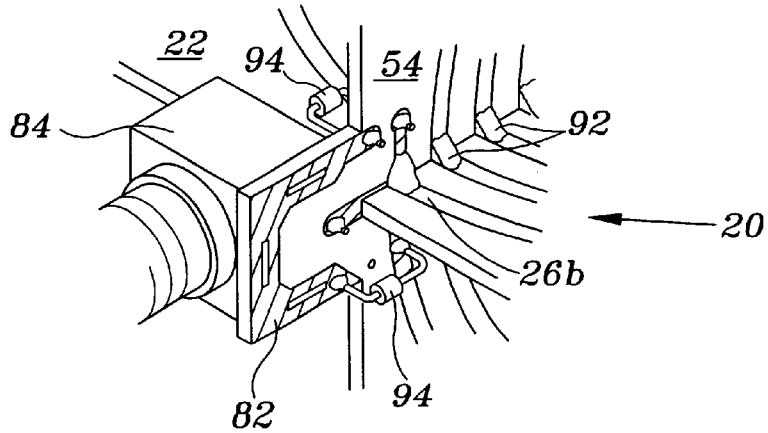
FIG. 7 is an enlarged portion of the connector section of the antenna shown in FIG. 6.
Figure 8:
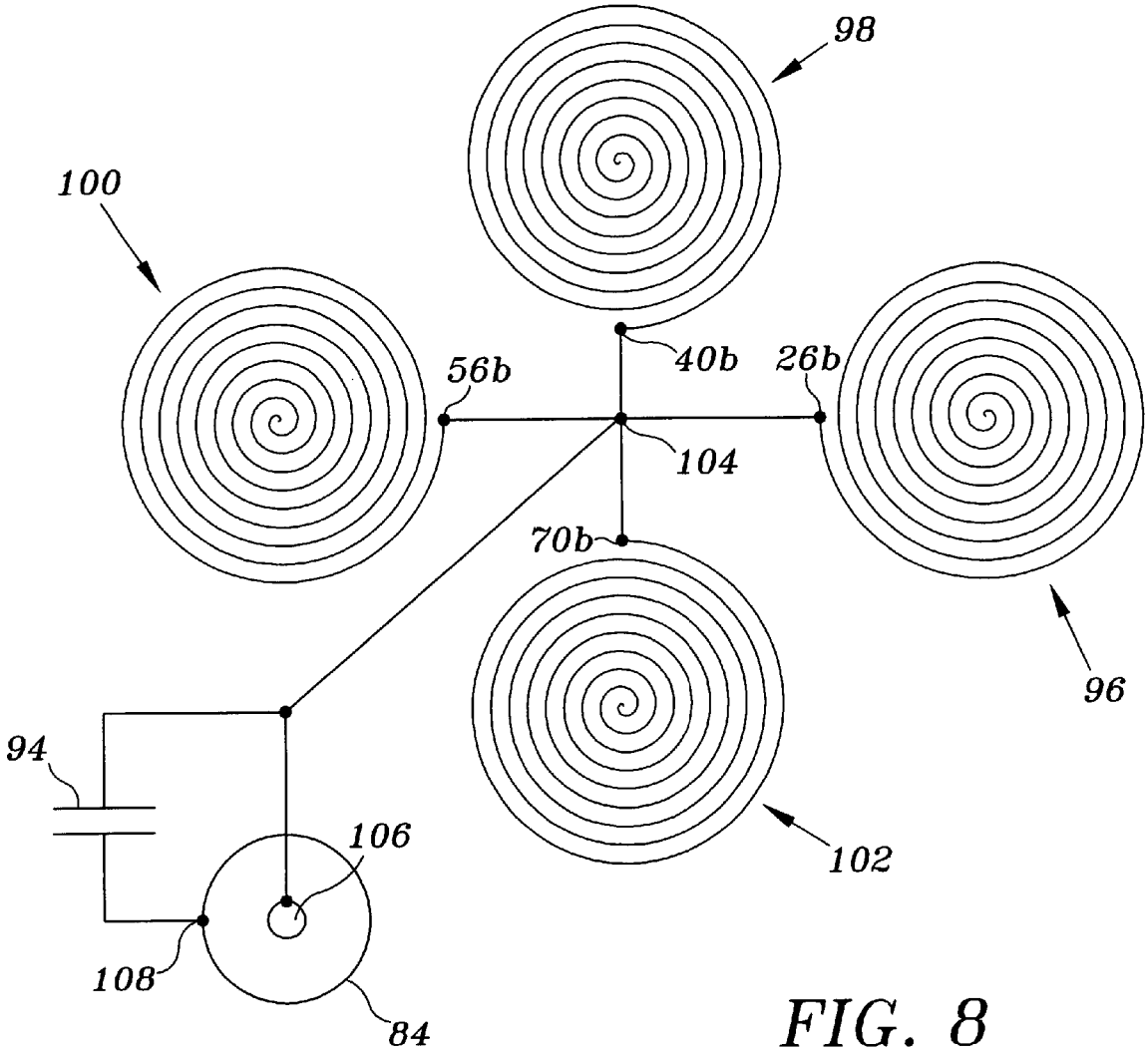
FIG. 8 is an electrical schematic diagram of the antenna shown in FIG. 6.

Referring now to FIGS. 6 and 7, ends 26*b*, 40*b*, 56*b*, and 70*b* of each spiral pattern are interconnected to antenna connector 84 utilizing a capacitor 94. Each end of spiral patterns 26, 40, 56, and 70 are connected to either the center lead 106 of antenna connector 84 or to the ground reference 108 of antenna connector 84. Through this connection, each spiral pattern 26, 40, 56, and 70 are interconnected together. As illustrated in FIG. 8, the half-spiral patterns of antenna 90 are illustrated as completed spiral patterns bridging substrates 20 and 50 to form continuous spiral patterns 96, 98, 100 and 102. The ends 26*b*, 40*b*, 56*b*, and 70*b* of completed spiral patterns 96, 98, 100, and 102, respectively, are interconnected at reference point 104 to the center lead 106 of antenna connector 84 and through a capacitor 94 to the ground reference 108 of antenna connector 84.

The size of spiral patterns 26, 40, 56, and 70 are determined by the frequency range that antenna 90 operates at in a waveguide for tuning such frequencies. Due to the electromagnetic effects of spiral patterns 26, 40, 56, and 70, the resonators of each spiral pattern are mutually coupled to increase the operating bandwidth. Impedance matching for each spiral pattern is performed for maximization of energy transfer. Antenna 90 provides a simple, broadband, antenna suitable for incorporation into any transmitter or receiver of analog and/or digital signals at broad frequency ranges.

Figure 9:
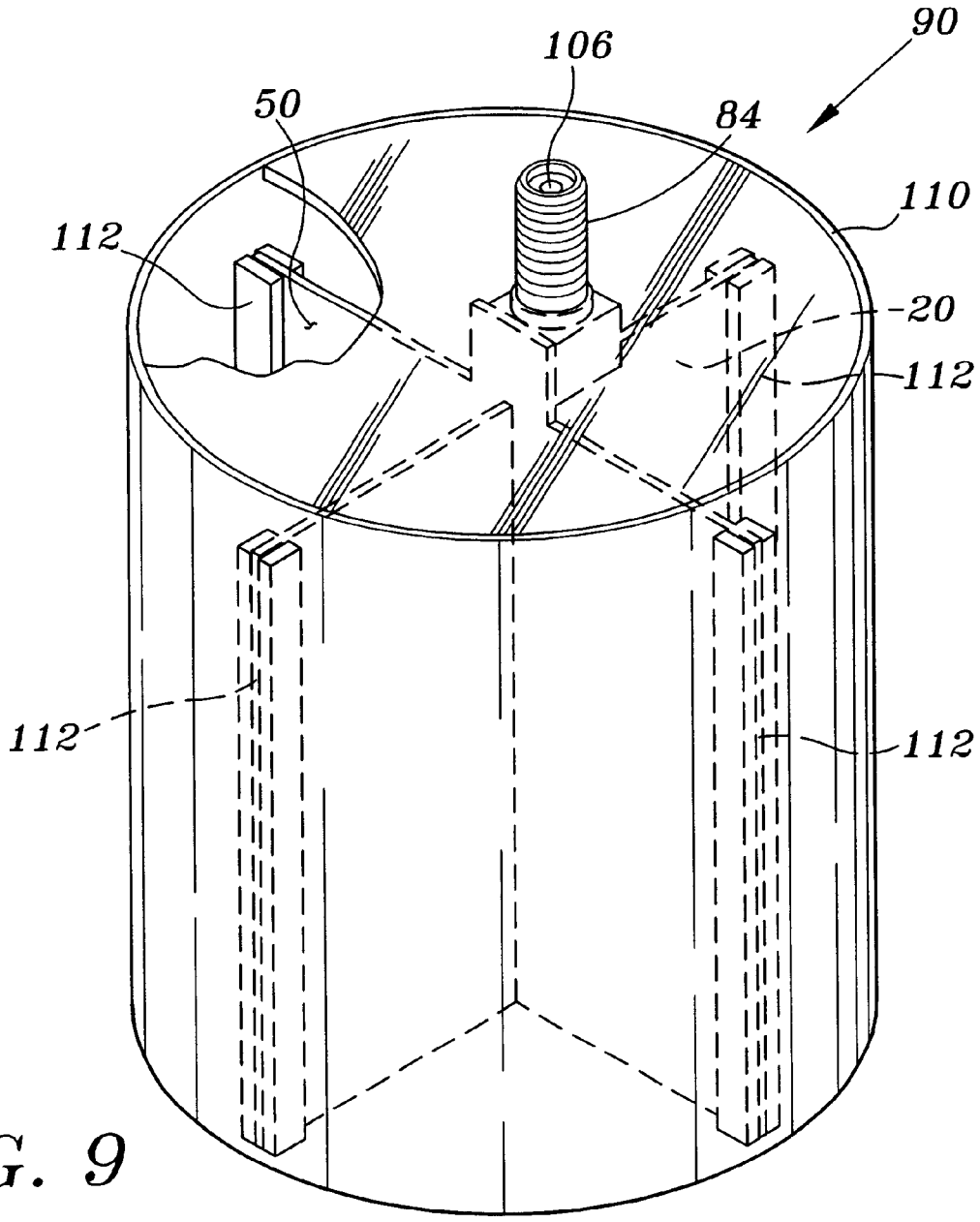
FIG. 9 is a perspective view of the antenna shown in FIG. 6 in a housing.

Referring now to FIG. 9, antenna 90 is illustrated in a housing 110. Housing 110 includes tracks 112, disposed 90° apart for receiving substrates 20 and 50. Substrates 20 and 50 are slidably mounted within tracks 112. Tracks 112 provide support for antenna 90 within housing 110. Housing 110 may be filled with epoxy to provide farther support and environmental protection for antenna 90. Housing 110 may be mounted in a variety of locations, such as, for example, a roof, attic, under an eave of a home, or in combination with a satellite dish.

Figure 10:
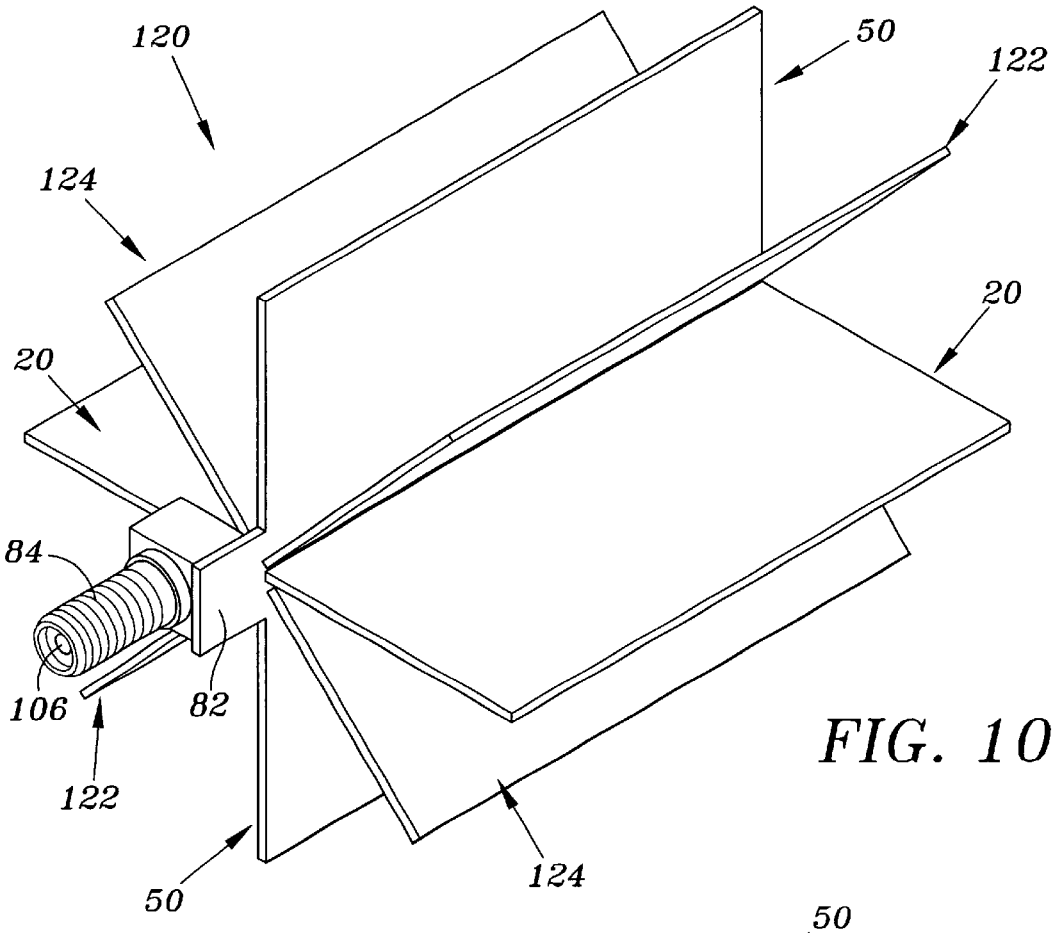
FIG. 10 is a perspective view of an additional embodiment of the present antenna.
Figure 11:
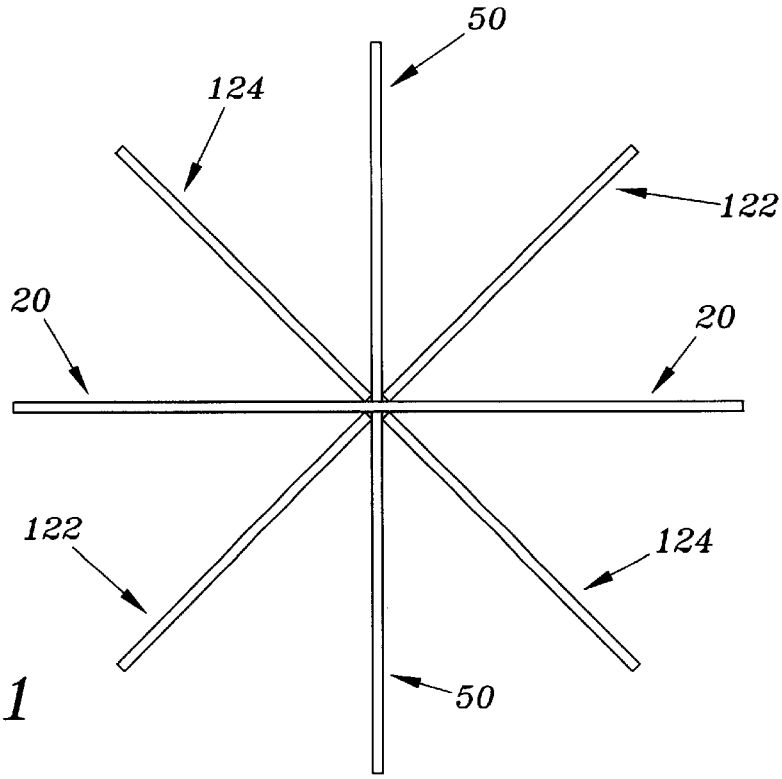
FIG. 11 is an end view of the antenna shown in FIG. 10.

Referring now to FIGS. 10 and 11, an additional embodiment of the present invention is illustrated. FIGS. 10 and II illustrate an antenna, generally identified by the numeral 120 including four substrates angularly spaced apart at approximately 45°. In addition to substrates 20 and 50, antenna 120 includes substrates generally identified by numerals 122 and 124. Each substrate 20, 50, 122, and 124 include half spiral patterns, and completed spiral patterns are formed between adjacent top and bottom surfaces of substrates 20, 50, 122, and 124. A spiral pattern is created between the top surface of substrate 20 and bottom surface of substrate 122, top surface of substrate 122 and bottom surface of substrate 50, top surface of substrate 50 and bottom surface of substrate 124, top surface of substrate 124 and top surface of substrate 20, bottom surface of substrate 20 and top surface of substrate 122, bottom surface of substrate 122 and top surface of substrate 50, bottom surface of substrate 50 and top surface of substrate 124, and bottom surface of substrate 124 and bottom surface of substrate 20. As a result, eight completed spiral patterns are formed in antenna 120. Antennas 90 and 120 of the present invention are shown for illustrative purposes. It being understood that through the use of three substrates, six completed spirals are formed, and any number of substrates can be utilized with the present invention. Additionally, a single substrate having a complete spiral pattern on each surface can be utilized with the present invention such as a substrate illustrated in FIGS. 1 and 2 having no gaps 30 or slot 32, and in which each spiral pattern is interconnected through a capacitor to form an antenna in a single plane.

Figure 12:
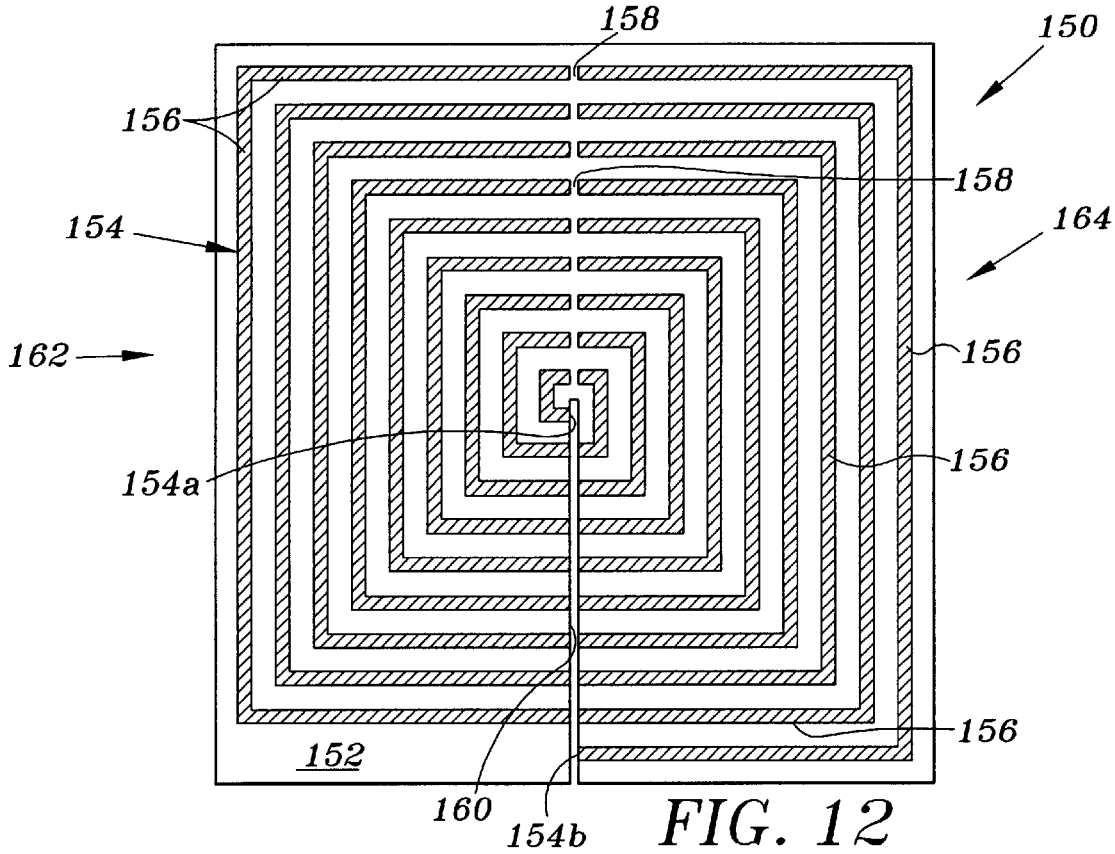
FIG. 12–15 are top plan views of a substrate of additional embodiments of the elements of the present antenna.

Referring to FIG. 12, a substrate, generally identified by the numeral 150 is illustrated. Substrate 150 comprises one element of the present antenna, and may be fabricated, for example, from printed circuit board material. FIG. 12 illustrates top surface 152 of substrate 150, it being understood that the bottom surface of substrate 150 includes a similar pattern. Disposed on top surface 152 of substrate 150 is a spiral pattern formed of a conductive material such as, for example, copper, and is generally identified by the numeral 154. Spiral pattern 154 includes end 154*a* centrally disposed on top surface 152 of substrate 150 and end 154*b* disposed along the peripheral edge of substrate 150. Spiral pattern 154 is generally square in shape. Spiral pattern 154 includes a plurality of spaced apart linear segments 156 which extend between ends 154*a* and 154*b*. Disposed within linear segments 156 is a gap 158. Centrally disposed within substrate 150 is a slot 160. Slot 160 is aligned with gaps 158. Slot 160 and gaps 158 form half spiral patterns, generally identified by the numerals 162 and 164. A pair of substrates 150 are interconnected as illustrated in FIGS. 5 and 6 to form an antenna 90 formed by adjacent half spiral patterns 162 and 164 connected by solder bridges 92.

Figure 13:
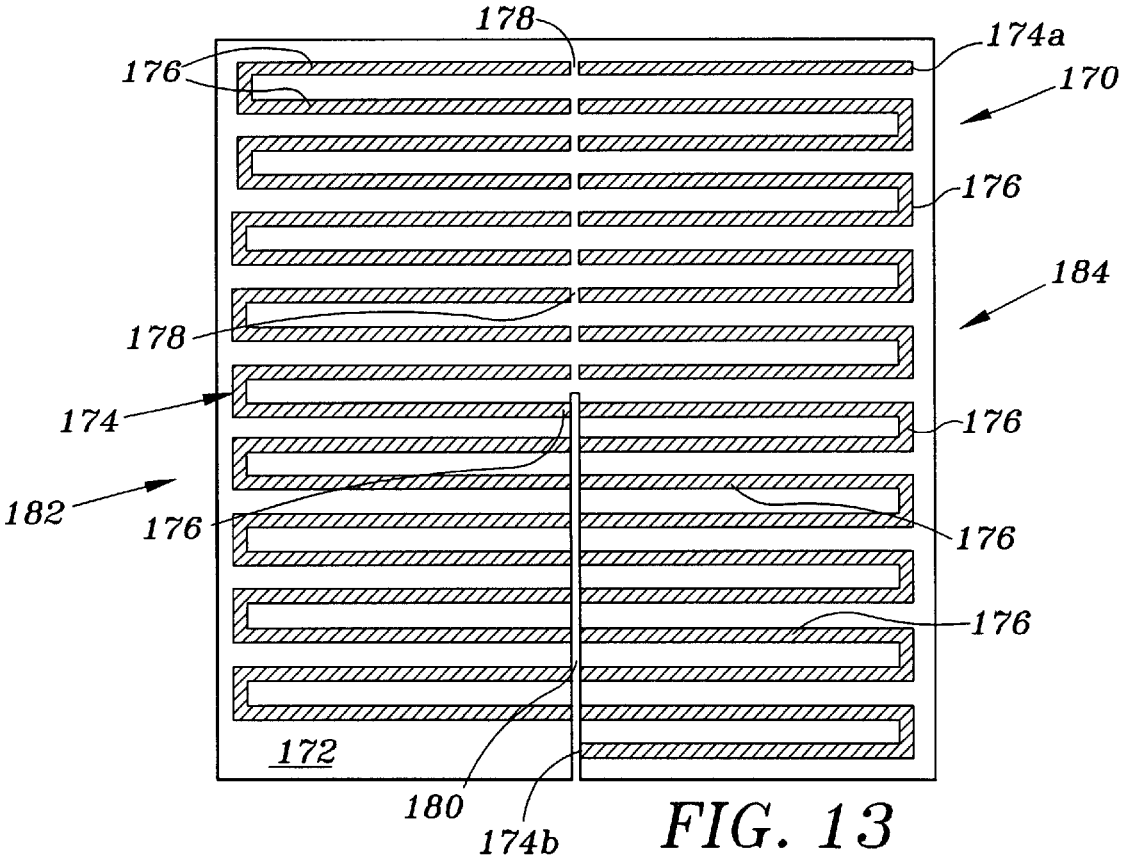

Referring to FIG. 13, a substrate, generally identified by the numeral 170 is illustrated. Substrate 170 comprises one element of the present antenna, and may be fabricated, for example, from printed circuit board material. FIG. 13 illustrates top surface 172 of substrate 170, it being understood that the bottom surface of substrate 170 includes a similar pattern. Disposed on top surface 172 of substrate 170 is a spiral pattern formed of a conductive material such as, for example, copper, and is generally identified by the numeral 174. Spiral pattern 174 includes end 174*a* disposed along the top peripheral edge of top surface 172 of substrate 170 and end 174*b* disposed along the bottom peripheral edge of top surface 172 of substrate 170. Spiral pattern 174 is generally rectangular in shape. Spiral pattern 174 includes a plurality of spaced apart linear segments 176 which extend between ends 174*a* and 174*b*. Disposed within linear segments 176 is a gap 178. Centrally disposed within substrate 170 is a slot 180. Slot 180 is aligned with gaps 178. Slot 180 and gaps 178 form half spiral patterns, generally identified by the numerals 182 and 184. A pair of substrates 170 are interconnected as illustrated in FIGS. 5 and 6 to form an antenna 90 formed by adjacent half spiral patterns 182 and 184 connected by solder bridges 92.

Figure 14:
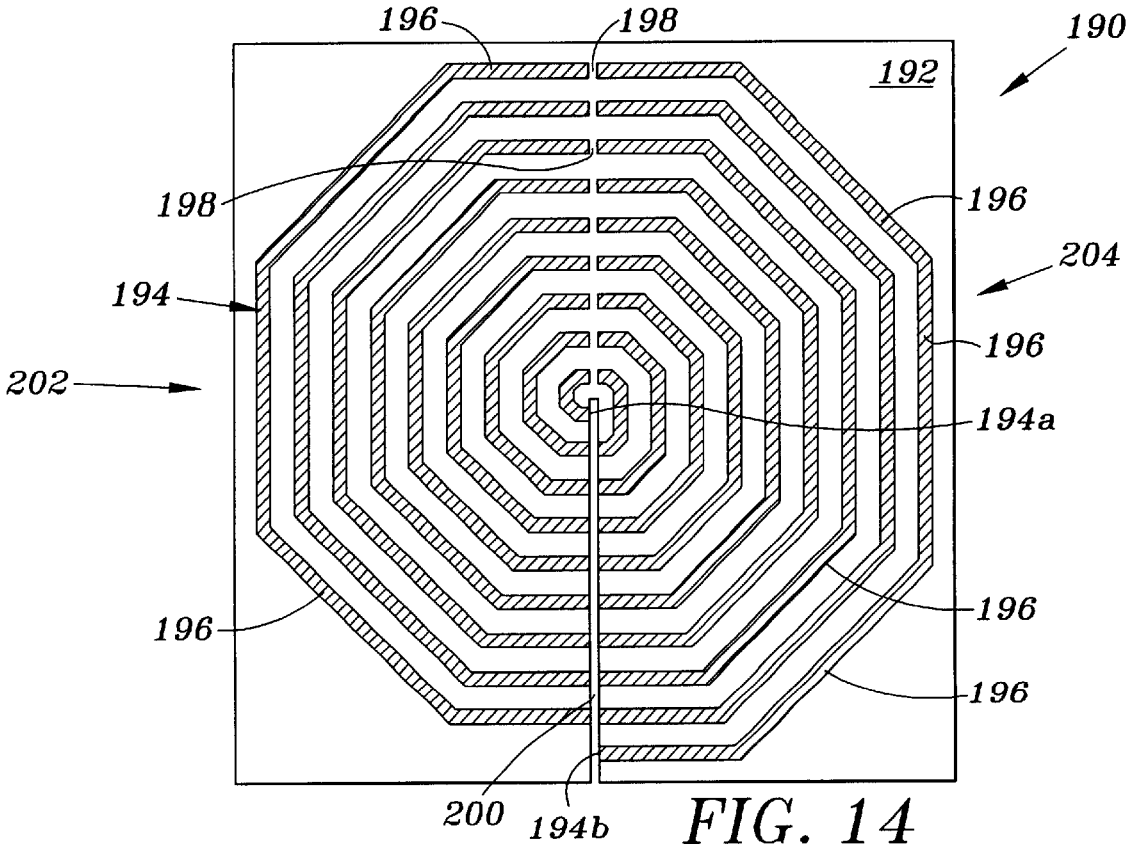

Referring to FIG. 14, a substrate, generally identified by the numeral 190 is illustrated. Substrate 190 comprises one element of the present antenna, and may be fabricated, for example, from printed circuit board material. FIG. 14 illustrates top surface 192 of substrate 190, it being understood that the bottom surface of substrate 190 includes a similar pattern. Disposed on top surface 192 of substrate 190 is a spiral pattern formed of a conductive material such as, for example, copper, and is generally identified by the numeral 194. Spiral pattern 194 includes end 194*a* centrally disposed on top surface 192 of substrate 190 and end 194*b* disposed along the peripheral edge of substrate 190. Spiral pattern 194 is generally octagonal in shape. Spiral pattern 194 includes a plurality of spaced apart linear segments 196 which extend between ends 194*a* and 194*b*. Disposed within linear segments 196 is a gap 198. Centrally disposed within substrate 190 is a slot 200. Slot 200 is aligned with gaps 198. Slot 200 and gaps 198 form half spiral patterns, generally identified by the numerals 202 and 204. A pair of substrates 190 are interconnected as illustrated in FIGS. 5 and 6 to form an antenna 90 formed by adjacent half spiral patterns 202 and 204 connected by solder bridges 92.

Figure 15:
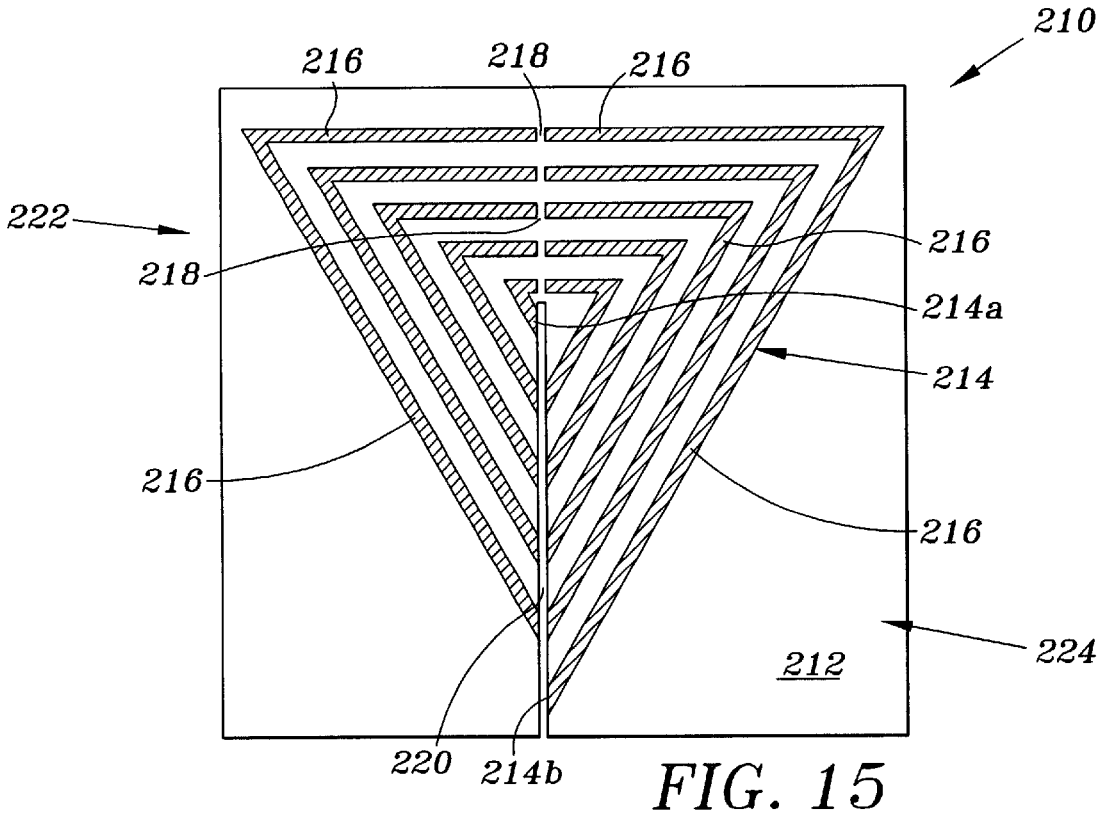

Referring to FIG. 15, a substrate, generally identified by the numeral 210 is illustrated. Substrate 210 comprises one element of the present antenna, and may be fabricated, for example, from printed circuit board material. FIG. 15 illustrates top surface 212 of substrate 210, it being understood that the bottom surface of substrate 210 includes a similar pattern. Disposed on top surface 212 of substrate 210 is a spiral pattern formed of a conductive material such as, for example, copper, and is generally identified by the numeral 214. Spiral pattern 214 includes end 214*a* centrally disposed on top surface 212 of substrate 210 and end 214*b* disposed along the peripheral edge of substrate 210. Spiral pattern 214 is generally triangular in shape. Spiral pattern 214 includes a plurality of spaced apart linear segments 216 which extend between ends 214*a* and 214*b*. Disposed within linear segments 216 is a gap 218. Centrally disposed within substrate 210 is a slot 220. Slot 220 is aligned with gaps 218. Slot 220 and gaps 218 form half spiral patterns, generally identified by the numerals 222 and 224. A pair of substrates 210 are interconnected as illustrated in FIGS. 5 and 6 to form an antenna 90 formed by adjacent half spiral patterns 222 and 224 connected by solder bridges 92.

It therefore can be seen that the present antenna provides for multidirectional elements having spiral patterns, having a low profile and which produces high-energy gain.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. An antenna having a terminal, the antenna comprising;

a first substrate having a top surface, a bottom surface, and a peripheral edge;

a first conductive trace disposed on said top surface of said first substrate, said first conductive trace having first and second ends and a plurality of spaced apart linear segments disposed between said first and second ends thereof forming a spiral pattern, said first end thereof being located centrally on said top surface of said first substrate and said second end thereof located adjacent to said peripheral edge;

each of said plurality of linear segments of said first conductive trace including a gap and said gaps being linearly aligned;

a second substrate having a top surface, a bottom surface, and a peripheral edge;

a second conductive trace disposed on said bottom surface of said second substrate, said second conductive trace having first and second ends and a plurality of spaced apart linear segments disposed between said first and second ends thereof forming a spiral pattern, said first end thereof being located centrally on said bottom surface of said second substrate and said second end thereof located adjacent to said peripheral edge;

each of said plurality of linear segments of said second conductive trace including a gap and said gaps being linearly aligned;

said first substrate being angularly disposed adjacent to said second substrate, such that said gaps of said first conductive trace are disposed adjacent to and linearly aligned with said gaps of said second conductive trace;

said first conductive trace and said second conductive trace being connected adjacent their respective gaps to form a continuous trace having a spiral shape extending between said top surface of said first substrate and said bottom surface of said second substrate; and said second end of said first conductive trace being connected to the antenna terminal.

2. The antenna of claim 1 wherein said first and second substrates are disposed at an angle of approximately 90°.

3. The antenna of claim 1 wherein said spiral patterns have a generally rectangular shape.

4. The antenna of claim 1 wherein said spiral patterns have a generally square shape.

5. The antenna of claim 1 wherein said spiral patterns have a generally triangular shape.

6. The antenna of claim 1 wherein said spiral patterns have a generally octagonal shape.

7. An antenna having a terminal, the antenna comprising:

a first substrate having a top surface, a bottom surface, and a peripheral edge;

a first conductive trace disposed on said top surface of said first substrate, said first conductive trace having first and second ends and a plurality of spaced apart linear segments disposed between said first and second ends thereof forming a spiral pattern, said first end thereof being located centrally on said top surface of said first substrate and said second end thereof located adjacent to said peripheral edge;

each of said plurality of linear segments of said first conductive trace including a gap and said gaps being linearly aligned;

a second conductive trace disposed on said bottom surface of said first substrate, said second conductive trace having first and second ends and a plurality of spaced apart linear segments disposed between said first and second ends thereof forming a spiral pattern, said first end thereof being located centrally on said bottom surface of said first substrate and said second end thereof located adjacent to said peripheral edge;

each of said plurality of linear segments of said second conductive trace including a gap and said gaps being linearly aligned;

a second substrate having a top surface, a bottom surface, and a peripheral edge;

a third conductive trace disposed on said top surface of said second substrate, said third conductive trace having first and second ends and a plurality of spaced apart linear segments disposed between said first and second ends thereof forming a spiral pattern, said first end thereof being located centrally on said top surface of said second substrate and said second end thereof located adjacent to said peripheral edge;

each of said plurality of linear segments of said third conductive trace including a gap and said gaps being linearly aligned;

a fourth conductive trace disposed on said bottom surface of said second substrate, said fourth conductive trace having first and second ends and a plurality of spaced apart linear segments disposed between said first and second ends thereof forming a spiral pattern, said first end thereof being located centrally on said bottom surface of said second substrate and said second end thereof located adjacent to said peripheral edge;

each of said plurality of linear segments of said fourth conductive trace including a gap and said gaps being linearly aligned;

said first substrate being angularly disposed adjacent to said second substrate, such that said gaps of said first, second, third, and fourth conductive traces are disposed adjacent to and linearly aligned with each other;

said first conductive trace and said fourth conductive trace being connected adjacent their respective gaps to form a first continuous trace having a spiral shape extending between said top surface of said first substrate and said bottom surface of said second substrate;

said third conductive trace and said first conductive trace being connected adjacent their respective gaps to form a second continuous trace having a spiral shape extending between said top surface of said first substrate and said top surface of said second substrate;

said second conductive trace and said third conductive trace being connected adjacent their respective gaps to form a third continuous trace having a spiral shape extending between said bottom surface of said first substrate and said top surface of said second substrate;

said fourth conductive trace and said second conductive trace being connected adjacent their respective gaps to form a fourth continuous trace having a spiral shape extending between said bottom surface of said second substrate and said bottom surface of said first substrate; and said second ends of said first, second, third and fourth conductive traces being connected to the antenna terminal.

8. The antenna of claim 7 wherein said first and second substrates are disposed at an angle of approximately 90°.

9. The antenna of claim 7 wherein said spiral patterns have a generally rectangular shape.

10. The antenna of claim 7 wherein said spiral patterns have a generally square shape.

11. The antenna of claim 7 wherein said spiral patterns have a generally triangular shape.

12. The antenna of claim 7 wherein said spiral patterns have a generally octagonal shape.

* * * * *